US009864311B2

(12) United States Patent
Sueyoshi

(10) Patent No.: US 9,864,311 B2
(45) Date of Patent: Jan. 9, 2018

(54) TEMPERATURE DETECTION DEVICE AND IMAGE FORMING APPARATUS

(71) Applicant: Kenji Sueyoshi, Osaka (JP)

(72) Inventor: Kenji Sueyoshi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/311,561

(22) PCT Filed: May 11, 2015

(86) PCT No.: PCT/JP2015/064123
§ 371 (c)(1),
(2) Date: Nov. 16, 2016

(87) PCT Pub. No.: WO2015/190223
PCT Pub. Date: Dec. 17, 2015

(65) Prior Publication Data

US 2017/0102649 A1 Apr. 13, 2017

(30) Foreign Application Priority Data

Jun. 10, 2014 (JP) ..... 2014-119764

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
(Continued)

(56) References Cited

U.S. PATENT DOCUMENTS 9,235,182 B2 * 1/2016 Fukushi ..... G03G 15/70
2002/0051663 A1 * 5/2002 Kinouchi ..... G03G 15/2053 399/330

(Continued)

FOREIGN PATENT DOCUMENTS

JP H05-333742 12/1993
JP H09-106212 4/1997

(Continued)

OTHER PUBLICATIONS

International Search Report dated Jun. 23, 2015 in PCT/JP2015/064123 filed on May 11, 2015.

(Continued)

*Primary Examiner* — Susan Lee
(74) *Attorney, Agent, or Firm* — IPUSA, PLLC

(57) ABSTRACT

A temperature detection device includes first and second temperature detection units configured to detect first and second temperatures, respectively, of a first roller at first and second positions in an axis direction, heated by a central heating unit and an end part heating unit; third and fourth temperature detection units configured to detect third and fourth temperatures, respectively, of a second roller which can be in pressure-contact with the first roller, at the first and second positions; and a control unit configured to control the heating units. The control unit determines a state of at least one of the first, second, third and fourth temperature detection units based on a comparison between first and third rise rates of the first and third temperatures, respectively, or on a comparison between second and fourth rise rates of the second and fourth temperatures, respectively.

10 Claims, 7 Drawing Sheets

(58) Field of Classification Search
USPC ..... 399/33
See application file for complete search history.

(56) References Cited

U.S. PATENT DOCUMENTS

| | | | | |
|---|---|---|---|---|
| 2007/0166062 | A1* | 7/2007 | Shimokawa | G03G 15/2042 399/33 |
| 2007/0292155 | A1* | 12/2007 | Kida | G03G 15/80 399/69 |
| 2009/0252521 | A1 | 10/2009 | Takami | |
| 2013/0195493 | A1 | 8/2013 | Hase et al. | |

FOREIGN PATENT DOCUMENTS

| | | | |
|---|---|---|---|
| JP | H11-184359 | | 7/1999 |
| JP | 2005-062491 | | 3/2005 |
| JP | 2008-009183 | | 1/2008 |
| JP | 2008102413 | A * | 5/2008 |
| JP | 2009-294591 | | 12/2009 |
| JP | 4430957 | | 3/2010 |
| JP | 2010-217764 | | 9/2010 |
| JP | 2011-036002 | | 2/2011 |
| JP | 2011-186389 | | 9/2011 |
| JP | 2012-047775 | | 3/2012 |
| JP | 2012-189707 | | 10/2012 |
| JP | 2013-218025 | | 10/2013 |
| JP | 2014-164183 | | 9/2014 |

OTHER PUBLICATIONS

Extended European Search Report for 15806605.0 dated May 10, 2017.

* cited by examiner

TEMPERATURE DETECTION DEVICE AND IMAGE FORMING APPARATUS

TECHNICAL FIELD

The disclosure herein generally relates to a temperature detection device and an image forming apparatus, especially relating to a temperature detection device for detecting a temperature of a heating roller which is heated by plural heaters and with which a pressure roller can be in pressure-contact.

BACKGROUND ART

In image forming apparatuses, such as printers, toner images formed on paper are fixed on the paper by fixing devices. In order to fix toner images on paper by heat and pressure at the fixing devices, the image forming apparatuses detect temperatures of heating rollers by temperature detection elements and control heaters in the heating rollers at optimum temperatures (target temperatures).

Accordingly, it becomes difficult to control the temperature due to an abnormality in the temperature detection element. Patent Document 1 discloses detecting abnormality in a temperature detection element. Patent Document 1 discloses an abnormality detection method for detecting an abnormality in a temperature detection element by, in the case where although the temperature detection element itself remains normal a temperature becomes impossible to be detected normally, monitoring outputs from plural temperature detection elements arranged on an outer periphery of a heating roller at intervals, and comparing temperature rise rates of the temperature detection elements with each other.

CITATION LIST

Patent Literature

Patent Document 1: Japanese Patent No. 4430957.

DISCLOSURE OF INVENTION

Problem to be Solved by the Invention

The abnormality detection method disclosed in Patent Document 1 has the following problems.

FIG. 1 is a diagram illustrating a schematic configuration of the heating roller disclosed in Patent Document 1. As shown in FIG. 1, the heating roller 106, provided with plural fixing heaters, often has two heaters, i.e. a central heater 111 for heating a central region and an end part heater 112 for heating an end portion. In the heating roller 106 temperature detection elements 1001 and 1002 are arranged at intervals, and rise rates of the respective temperature detection elements are compared. In such a configuration, in the case either of the central heater 111 or the end part heater 112 is turned on, the rise rates usually become different from each other, and an abnormality may be erroneously detected even though the temperature detection elements operate normally.

In view of the above subject matter, it is a general object of at least one embodiment of the present invention to provide a temperature detection device and an image forming apparatus that substantially obviate one or more problems caused by the limitations and disadvantages of the related art.

Means to Solve the Problem

According to an aspect of the invention, a temperature detection device includes a first temperature detection unit configured to detect a first temperature of a first roller at a first position in an axis direction of the first roller; a second temperature detection unit configured to detect a second temperature of the first roller at a second position in the axis direction of the first roller, the second position being separated from the first position, the first roller being configured to be heated by a plurality of heating units including a central heating unit and an end part heating unit; a third temperature detection unit configured to detect a third temperature of a second roller at a position substantially the same as the first position in the axis direction of the first roller, the second roller being configured to be in pressure-contact with the first roller; a fourth temperature detection unit configured to detect a fourth temperature of the second roller at a position substantially the same as the second position in the axis direction of the first roller; and a control unit configured to control the plurality of heating units. The control unit determines a state of at least one of the first, second, third and fourth temperature detection units based on a comparison between a first rise rate of the first temperature and a third rise rate of the third temperature or on a comparison between a second rise rate of the second temperature and a fourth rise rate of the fourth temperature.

According to another aspect of the invention, an image forming apparatus includes the temperature detection device, which includes a first temperature detection unit configured to detect a first temperature of a first roller at a first position in an axis direction of the first roller; a second temperature detection unit configured to detect a second temperature of the first roller at a second position in the axis direction of the first roller, the second position being separated from the first position, the first roller being configured to be heated by a plurality of heating units including a central heating unit and an end part heating unit; a third temperature detection unit configured to detect a third temperature of a second roller at a position substantially the same as the first position in the axis direction of the first roller, the second roller being configured to be in pressure-contact with the first roller; a fourth temperature detection unit configured to detect a fourth temperature of the second roller at a position substantially the same as the second position in the axis direction of the first roller; and a control unit configured to control the plurality of heating units. The control unit determines a state of at least one of the first, second, third and fourth temperature detection units based on a comparison between a first rise rate of the first temperature and a third rise rate of the third temperature or on a comparison between a second rise rate of the second temperature and a fourth rise rate of the fourth temperature.

According to embodiments of the present invention, a temperature detection device and an image forming apparatus that can determine an abnormality in a temperature detection element of a fixing device provided with plural heaters are provided.

BEST MODE FOR CARRYING OUT THE INVENTION

In the following, embodiment of the present invention will be described with reference to the accompanying drawings.

Figure 1:
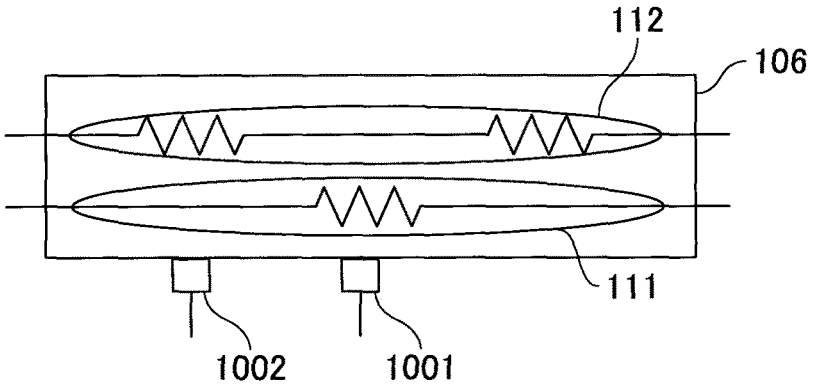
FIG.1 RELATED ART
FIG. 1 is a diagram illustrating an example of a schematic configuration of a heating roller according to the related art.
Figure 2:
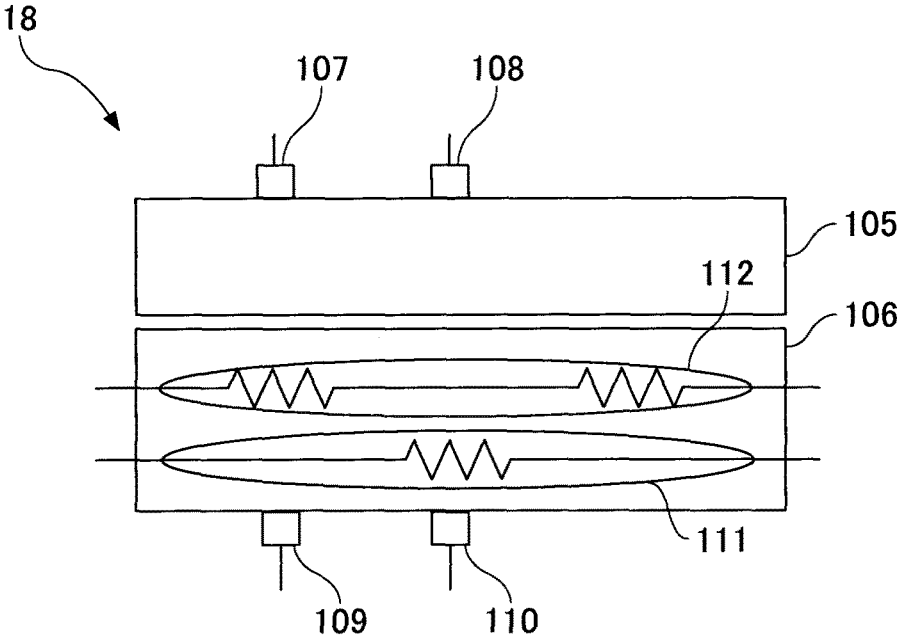
FIG. 2 is a diagram for explaining an example of an arrangement of plural temperature detection elements arranged for a heating roller and a pressure roller according to a present embodiment.

The present invention will be explained with reference to FIG. 2. FIG. 2 is a diagram for explaining an example of an arrangement of plural temperature detection elements arranged for a heating roller 106 and a pressure roller 105. As shown in FIG. 2, two temperature detection elements (a central-heating roller temperature detection element 110 and an end part-heating roller temperature detection element 109) are arranged for the heating roller 106, and two temperature detection elements (a central-pressure roller temperature detection element 108 and an end part-pressure roller temperature detection element 107) are arranged for the pressure roller 105.

The central-heating roller temperature detection element 110 and the central-pressure roller temperature detection element 108 are arranged at almost the same position in axis directions (almost at the center) of the heating roller 106 and the pressure roller 105. Moreover, the end part-heating roller temperature detection element 109 and the end part-pressure roller temperature detection element 107 are arranged at almost the same position in axis directions (around the end portion) of the heating roller 106 and the pressure roller 105.

Since the central-pressure roller temperature detection element 108 and the end part-pressure roller temperature detection element 107 are far from a heater, a temperature rise rate of the central-pressure roller temperature detection element 108 is less than a temperature rise rate of the central-heating roller temperature detection element 110, and a temperature rise rate of the end part-pressure roller temperature detection element 107 is less than a temperature rise rate of the end part-heating roller temperature detection element 109. In the present embodiment, by using the above-described assumption, an abnormality in the central-pressure roller temperature detection element 108, the end part-pressure roller temperature detection element 107, the central-heating roller temperature detection element 110 and the end part-heating roller temperature detection element 109 is detected, as follows.

Determination 1: In the case where only the central heater 111 is turned on, it is determined whether a result of comparison between the temperature rise rates of the central-pressure roller temperature detection element 108 and of the central-heating roller temperature detection element 110 is within an assumed range (1-1). In the case where only the end part heater 112 is turned on, it is determined whether a result of comparison between the temperature rise rates of the end part-pressure roller temperature detection element 107 and of the end part-heating roller temperature detection element 109 is within an assumed range (1-2).

According to the comparison (1-1), an abnormality in the central-pressure roller temperature detection element 108 or the central-heating roller temperature detection element 110 can be detected. According to the comparison (1-2), an abnormality in the end part-pressure roller temperature detection element 107 or the end part-heating roller temperature detection element 109 can be detected.

Furthermore, there is an assumed relationship also between the temperature rise rates of the central-heating roller temperature detection element 110 and the end part-heating roller temperature detection element 109 arranged in the axis direction of the heating roller 106. That is, the temperature rise rate of the central-heating roller temperature detection element 110 is greater than the temperature rise rate of the end part-heating roller temperature detection element 109, and the temperature rise rate of the central-pressure roller temperature detection element 108 is greater than the temperature rise rate of the end part-pressure roller temperature detection element 107. However, in the case where only one of the central heater 111 and the end part heater 112 is turned on, the above-described relation may not be satisfied. Thus, in the present embodiment, an abnormality in the central-pressure roller temperature detection element 108, the end part-pressure roller temperature detection element 107, the central-heating roller temperature detection element 110 and the end part-heating roller temperature detection element 109 is detected as follows.

Determination 2: In the case where both the central heater 111 and the end part heater 112 are turned on, it is determined whether a result of comparison between the temperature rise rates of the central-heating roller temperature detection element 110 and of the end part-heating roller temperature detection element 109 is within an assumed range. Or, it is determined whether a result of comparison between the temperature rise rates of the central-pressure roller temperature detection element 108 and of the end part-pressure roller temperature detection element 107 is within an assumed range.

By combining Determination 1 and Determination 2, it can be determined whether an abnormality occurs in the central-pressure roller temperature detection element 108 or in the central-heating roller temperature detection element 110, and whether an abnormality occurs in the end part-pressure roller temperature detection element 107 or in the end part-heating roller temperature detection element 109.

Meanwhile, the central-heating roller temperature detection element 110 is an example of a first temperature detection unit in claims, the end part-heating roller temperature detection element 109 is an example of a second temperature detection unit in claims, the central-pressure roller temperature detection element 108 is an example of a third temperature detection unit and the end part-pressure roller temperature detection element 107 is an example of a fourth temperature detection unit.

[Example of Configuration]

Figure 3:
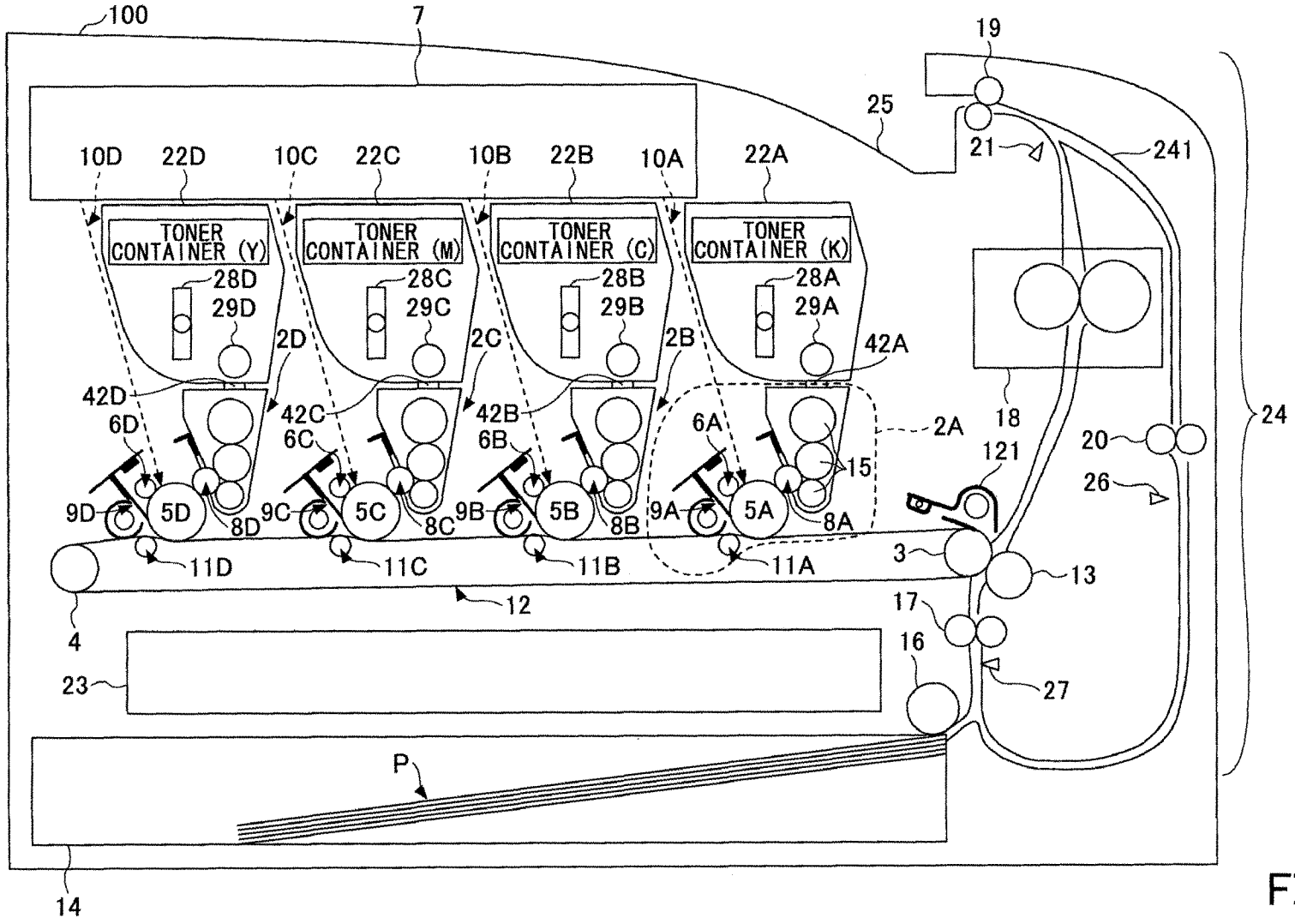
FIG. 3 is a diagram illustrating an example of a schematic configuration of an image forming apparatus according to the present embodiment.

FIG. 3 is a diagram illustrating an example of a schematic configuration of the image forming apparatus 100. The image forming apparatus 100 includes, as main component members, an exposure device 7, toner containers 22A to 22D, developing units 2A to 2D, a transfer belt 12, a waste toner box 23, a paper feeding tray 14, a paper conveyance mechanism 24, a fixing device 18 and a paper ejection tray 25.

The exposure device 7 emits light to photoconductors 5A to 5D and forms electrostatic latent images on the photoconductors 5A to 5D, respectively. The exposure device 7 mainly includes a type combining a laser light source and a polygon mirror, a type using an LED array, or the like. However, the exposure type may be arbitrary. Moreover, FIG. 3 illustrates the exposure device 7 which can emit four laser lights 10A to 10D so that a color image can be formed, but an exposure device 7 that can form an image of a single color may be used.

The exposure device 7 emits laser lights 10A to 10D to emission positions determined based on image data of respective colors of cyan, magenta, yellow and black, for example, removes charging on the photoconductors 5A to 5D and determines adhesion positions of toner.

The toner containers 22A to 22D have longer directions in a depth direction of the paper plane, and contain toner to be supplied to the developing units 2A to 2D. The toner containers 22A to 22D are detachably mounted on the image forming apparatus 100. The toner containers 22A to 22D include agitators 28A to 28D, screws 29A to 29D and toner supply clutches 42A to 42D, respectively. The agitators 28A to 28D are stirring members or loosening members that rotate around the depth direction of the paper plane. The screws 29A to 29D transport toner toward toner replenishing ports closed by the toner supply clutches 42A to 42D. The toner supply clutches 42A to 42D open/close the toner replenishing ports between the developing units 2A to 2D and the toner containers 22A to 22D, thereby switching a communication state and a separation state. In the case of the communication state, by the screws 29A to 29D rotating, prescribed amount of replenishment is supplied to the developing units 2A to 2D, respectively.

The developing units 2A to 2D are developing devices that accumulate toner and cause the toner to adhere to the photoconductors 5A to 5D, respectively. The developing units 2A to 2D include sets of supply rollers 15A to 15D and developing rollers 8A to 8D, respectively. Each of the sets of supply rollers 15A to 15D includes three supply rollers. Since there is a gap of about 2 or 3 mm between surfaces of the developing rollers 8A to 8D and the supply rollers 15A to 15D, the toner accumulated in the developing units 2A to 2D is transported from the supply rollers 15A to 15D to the developing rollers 8A to 8D, respectively. Meanwhile, the sets of supply rollers 15A to 15D may include one roller or two rollers, or may include stirring members instead of the supply rollers, respectively. The surfaces of the developing rollers 8A to 8D include electrically-conductive urethane rubber or silicone rubber, for example. The supply rollers 15A to 15D are sponge rollers, surfaces of which include foamed polyurethane or the like.

Meanwhile, developing blades are arranged along the axis direction of the developing rollers 8A to 8D from the surface at predetermined intervals. The developing blades regulate layer thicknesses of toner transported from the supply rollers 15A to 15D to the surfaces of the developing rollers 8A to 8D to a predetermined value.

Around the photoconductors 5A to 5D, charging rollers 6A to 6D, the developing rollers 8A to 8D, cleaning units 9A to 9D and transfer devices 11A to 11D are arranged, respectively. The charging rollers 6A to 6D charge the photoconductors 5A to 5D at high potential uniformly. The exposure device 7 emits laser light to the charged photoconductors 5A to 5D. Regions to which the laser light is emitted become electrostatic latent images of low potential parts, to which toner from the developing rollers 8A to 8D adheres. The toner on the photoconductors 5A to 5D is transferred to the transfer belt 12. Toner remaining after the transfer to the transfer belt 12 is removed by the cleaning units 9A to 9D, respectively. The cleaning units 9A to 9D include blades, toner collection units and conveyance screws, respectively. The blades scrape toner remaining on the photoconductors 5A to 5D and collect the toner into the toner collection unit. The conveyance screws convey the toner in the toner collection unit to the waste toner box 23.

The transfer belt 12 is an endless belt wound around a secondary transfer drive roller 3 which is rotary driven and a transfer belt tension roller 4. The transfer devices 11A to 11D are arranged opposed to the photoconductors 5A to 5D via the transfer belt 12, respectively. The transfer devices 11A to 11D are made to abut on an inner periphery of the transfer belt 12 and cause the transfer belt 12 to contact with the surfaces of the photoconductors 5A to 5D. When a voltage is applied to the transfer devices 11A to 11D, an electric field is generated and the toner on the photoconductors 5A to 5D is transferred onto the transfer belt 12.

A toner image on the transfer belt 12 is transferred onto a paper P by a secondary transfer roller 13. A cleaning device 121 is arranged on the right side of the transfer belt 12 in the paper plane. Remaining toner on the transfer belt 12 is collected and transported to the waste toner box 23.

A paper P to be supplied to a secondary transfer unit formed by the secondary transfer roller 13 and the secondary transfer drive roller 3 is placed on the paper feeding tray 14. A paper feeding roller 16, with which the paper feeding tray 14 is equipped, feeds the paper P, and a friction pad separates by every sheet. The paper P is conveyed by the paper conveyance mechanism 24 to the secondary transfer roller 13, the fixing device 18 and the paper ejection tray 25. The paper P conveyed by the paper feeding roller 16 is detected by a registration sensor 27 and retained at the registration roller 17 until a timing when a toner image reaches the secondary transfer unit.

The registration roller 17 sends the clamped paper P to the secondary transfer unit at a predetermined timing. The secondary transfer roller 13 is arranged opposed to the secondary transfer drive roller 3. The secondary transfer roller 13 is separated from the secondary transfer drive roller 3 only other than upon printing (Or, may always be in contact with each other). Upon printing, the secondary transfer roller 13 is made to abut the transfer belt 12 and a secondary transfer electric field is generated. According to the above-described processes, a full-color image is collectively transferred onto the paper P at the secondary transfer unit.

The fixing device 18 fixes the full-color image formed on the paper P to the paper P by an action of heat and pressure. In the case of single-side printing, the paper P is ejected to the paper ejection tray 25 as it is. On the other hand, in the case of double-sided printing, upon being detected by a paper ejection sensor 21 that a tail edge of the paper is passed, a paper ejection roller 19 rotates backward, and the paper P is conveyed to a double-sided printing paper feed path 241 with the front edge changed to a tail edge. When the paper P is detected by a double-side sensor 26, the paper P is conveyed on the double-sided printing paper feed path 241 by a double-side roller 20, conveyed to the secondary transfer unit again, and a full-color image is transferred onto the opposite side of the paper P this time.

Meanwhile, the image forming apparatus 100 shown in FIG. 3 is the so-called "tandem type". The image forming apparatus 100 according to the present embodiment may be the "four-cycle type", in which four toner images of respective colors are transferred in series on an intermediate transfer body overlaid with each other and the four toner images on the intermediate transfer body are transferred onto a paper at a same time. Moreover, without transferring a full-color image onto the transfer belt 12, a toner image may be formed directly on a paper.

Moreover, the image forming apparatus according to the present embodiment includes, in addition to the printer illustrated in the drawings, other image forming apparatus such as a facsimile apparatus, a copying machine having a function of a scanner, or a multifunction peripheral including at least one of the above apparatuses.

Figure 4:
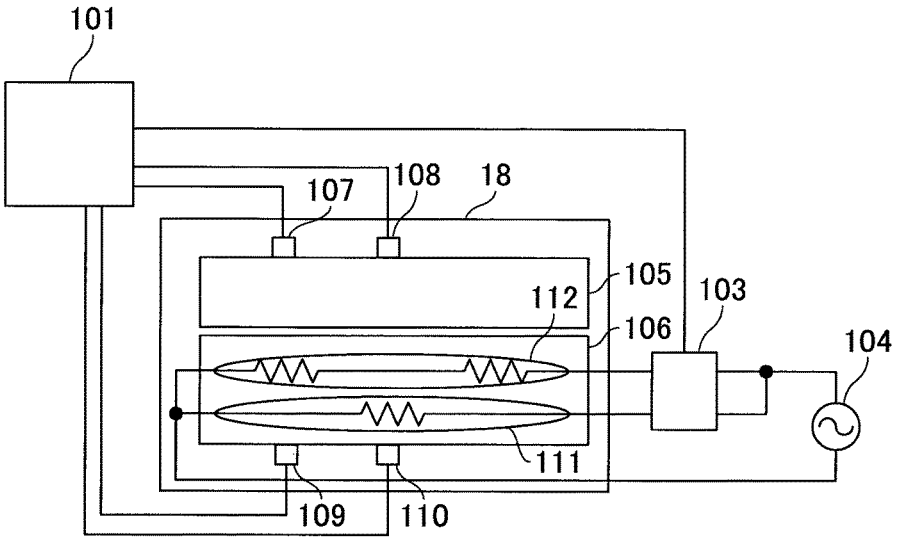
FIG. 4 is a diagram illustrating an example of a configuration of a fixing device included in the image forming apparatus according to the present embodiment.

FIG. 4 is a diagram illustrating an example of a configuration of the fixing device 18 included in the image forming apparatus 100. The fixing device 18 is connected to a control device 101, and a temperature of a surface of the heating roller 106 is controlled by the control device 101. The control device 101 is an example of a temperature detection device in claims.

The fixing device 18 includes a pair of the heating roller 106 and the pressure roller 105 which can be brought into pressure contact with each other. Moreover, roughly in the center of the heating roller 106 in the axis direction a central-heating roller temperature detection element 110 for detecting a temperature is arranged in a direction so as to be opposed to the heating roller 106. Moreover, in an end portion on the left of the paper plane in the axis direction of the heating roller 106, an end part-heating roller temperature detection element 109 for detecting a temperature is arranged in a direction so as to be opposed to the heating roller 106.

Similarly, roughly in the center of the pressure roller 105 in the axis direction a central-pressure roller temperature detection element 108 for detecting a temperature is arranged in a direction so as to be opposed to the pressure roller 105. Moreover, in an end portion on the left of the paper plane in the axis direction of the pressure roller 105, an end part-pressure roller temperature detection element 107 for detecting a temperature is arranged in a direction so as to be opposed to the pressure roller 105.

Meanwhile, in the illustrated example, two temperature detection elements are arranged on the outer periphery of each of the rollers. However, three or more temperature detection elements may be arranged.

The heating roller 106 includes a heater as a heat source for heating the heating roller 106. In the present embodiment, plural heaters as heat sources are arranged in the axis direction, and include a central heater 111 for heating the central region of the heating roller 106 and an end part heater 112 for heating the end portion of the heating roller 106.

Moreover, the temperature of the heating roller 106 is controlled by the control device 101 based on temperatures, which are detected by the central-heating roller temperature detection element 110 and the end part-heating roller temperature detection element 109 and output to the control device 101. Specifically, the temperature of the heating roller 106 is always detected, during when the image forming apparatus 100 operates, by the central-heating roller temperature detection element 110 and the end part-heating roller temperature detection element 109, and output to the control device 101.

Here, a surface temperature of the heating roller 106, at which the image forming apparatus 100 becomes possible to print, is defined as a target temperature. The outputs from the central-heating roller temperature detection element 110 and the end part-heating roller temperature detection element 109 are compared with the target temperature at the control device 101. In the case where the outputs from the central-heating roller temperature detection element 110 and the end part-heating roller temperature detection element 109 are less than the target temperature, by the operation of the control device 101, a switch 103 is set to ON, electric power is supplied to the central heater 111 and the end part heater 112 from an AC power source 104, and both the central heater 111 and the end part heater 112 are turned on.

Meanwhile, the central heater 111 and the end part heater 112 can be controlled individually by the control device 101, as necessary. That is, according to the temperatures detected by the central-heating roller temperature detection element 110 and the end part-heating roller temperature detection element 109, any one of the central heater 111 and the end part heater 112 can be turned on.

On the other hand, in the case where the outputs from the central-heating roller temperature detection element 110 and the end part-heating roller temperature detection element 109 are greater than the target temperature, the central heater 111 and the end part heater 112 which are heaters are turned off as heat sources. According to the above-described control, the surface temperature of the heating roller 106 is maintained at the target temperature.

The above-described temperature control is called an "on/off control method". More specifically, setting a cycle to n times a half wavelength of the AC power source 104 (for example, n is ten), an amount of heating is adjusted by controlling wave numbers for turning on the heaters during m time periods of the n time periods in response to a difference between temperatures.

Moreover, in the present embodiment, the temperature is controlled by using the central-heating roller temperature detection element 110 and the end part-heating roller temperature detection element 109 arranged in the heating roller 106. However, the temperature may be controlled by using the central-pressure roller temperature detection element 108 and the end part-pressure roller temperature detection element 107 arranged in the pressure roller 105.

<Disadvantage of Related Art>

Supplementary explanation for the disadvantage of the related art will be presented. In the related art including Patent Document 1, in addition to the problem that in the case where any one of the heaters of the central-heating roller temperature detection element 110 and of the end part-heating roller temperature detection element 109 is turned on, an abnormality may be erroneously detected even when the temperature detection elements operate normally. There is a disadvantage as follows.

The image forming apparatus is operated by electric power. Generally, an input voltage which secures an operation of the image forming apparatus is determined. For example, for image forming apparatuses sold in Japan, the input voltage, which guarantees an operation is determined such as "100 V+/−10%", for example.

An image forming apparatus is often designed under the strategy that in the case where the input voltage becomes out of range of guaranteed operation, the operation of the image forming apparatus is stopped. Then, a method of detecting that the input voltage is out of the range of guaranteed operation by using temperatures obtained from plural temperature detection elements arranged on an outer periphery of a heating roller at intervals of a fixing device has been studied.

However, the above-described method has the disadvantage that the following two states cannot be distinguished, i.e. (i) the input voltage is low, and (ii) an abnormality occurs in the temperature detection element and the detected temperature is lower than the actual temperature.

Figure 5:
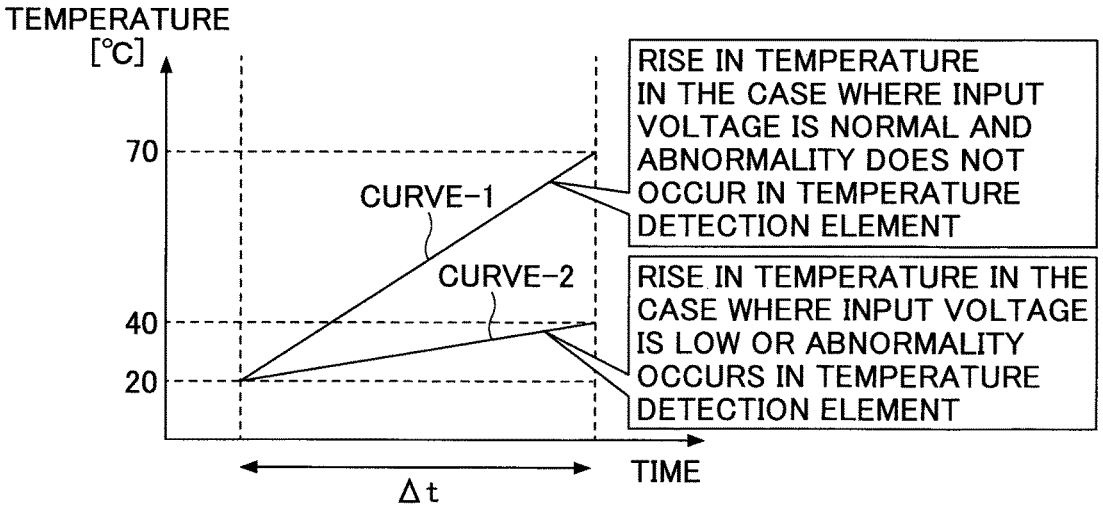
FIG. 5 is a diagram illustrating an example of temperature rise rates detected by the temperature detection element according to the present embodiment.

FIG. 5 is a diagram illustrating an example of temperature rise rates detected by the temperature detection element. The temperature detection element may be any of the central-heating roller temperature detection element 110 and the end part-heating roller temperature detection element 109.

In FIG. 5, CURVE-1 represents a rise of temperature in the case where the input voltage is normal and the temperature detection element is also normal. On the other hand, CURVE-2 represents a state where it is determined that an abnormality occurs since the temperature rise rate is less than that of CURVE-1. However, the state represented by CURVE-2 having a small temperature rise rate may be caused by the low input voltage or by an abnormality in the temperature detection element. Accordingly, two states (i) and (ii) cannot be distinguished.

For this reason, in the case where the temperature rise rate obtained from the temperature detection element is small, the image forming apparatus 100 is required to stop the operation of the apparatus. That is, in the case where the input voltage is low, even when an abnormality does not occur in the temperature detection element, the operation of the image forming apparatus 100 stops. As a result, when the image forming apparatus 100 is used in a location where the power supply condition is poor and the input voltage often drops, the image forming apparatus 100 often stops even if the temperature detection element is normal.

The fixing device 18 according to the present embodiment can solve the above-described disadvantage that an abnormality may be erroneously detected in the temperature detection element in the case of low input voltage, in addition to the above-described problem. Specifically, by combining Determination 1 and Determination 2, described as above, the state (i) where the input voltage is low and the state (ii) where an abnormality occurs in the temperature detection element and the detected temperature is lower than the actual temperature can be distinguished.

<Abnormality Determination>

At first, the temperature rise rate used for the abnormality determination will be explained with reference to FIG. 6.

Figure 6:
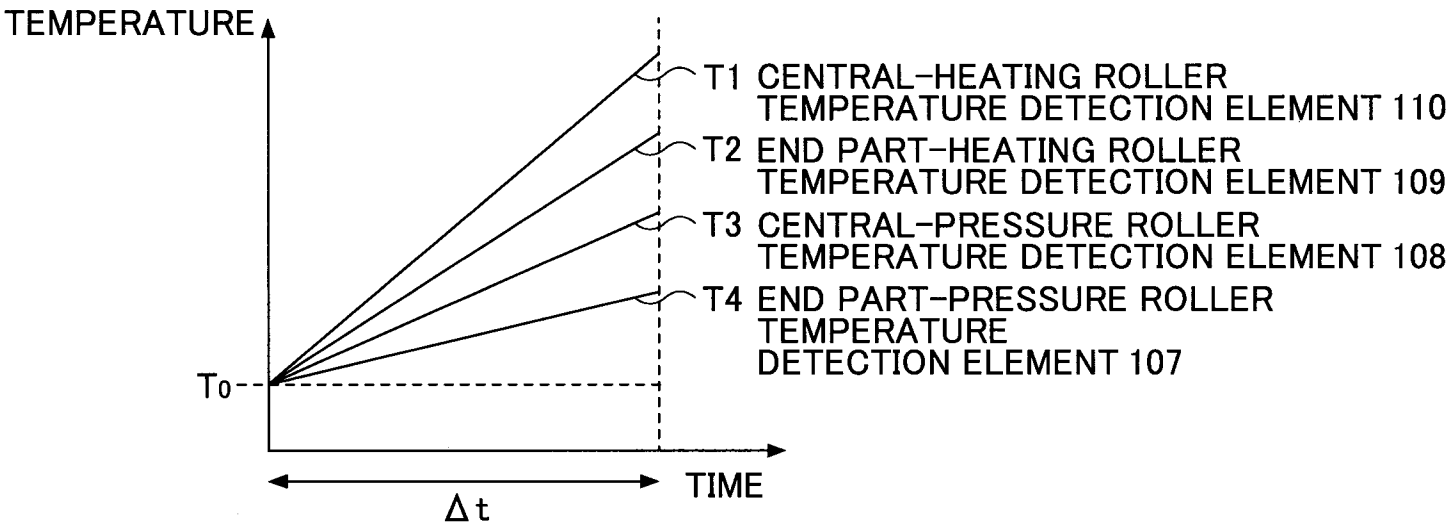
FIG. 6 is a diagram for explaining an example of temperature rise rates T1 to T4 of a central-heating roller temperature detection element, an end part-heating roller temperature detection element, a central-pressure roller temperature detection element and an end part-pressure roller temperature detection element, respectively, according to the present embodiment.

FIG. 6 is a diagram for explaining an example of the temperature rise rates T1 to T4 of the central-heating roller temperature detection element 110, the end part-heating roller temperature detection element 109, the central-pressure roller temperature detection element 108 and the end part-pressure roller temperature detection element 107, respectively.

The control device 101 calculates a temperature rise rate per unit time from when a fixing heater is turned on (in the case of only the central heater 111, in the case of only the end part heater 112 or in the case of both heaters), for each of the temperature detection elements. The temperature rise rates for the respective temperature detection elements are denoted by T1 to T4, i.e. T1 indicates the temperature rise rate for the central-heating roller temperature detection element 110; T2 indicates the temperature rise rate for the end part-heating roller temperature detection element 109; T3 indicates the temperature rise rate for the central-pressure roller temperature detection element 108; and T4 indicates the temperature rise rate for the end part-pressure roller temperature detection element 107. At the start of heating, all temperatures T1 to T4 are assumed to be an initial value T0. Meanwhile, the temperature rise rates shown in FIG. 6 are examples, and the relation among values of T1 to T4 is not always the relation shown in FIG. 6, i.e. T1>T2>T3>T4.

Moreover, further temperature rise rates A to C can be defined by using the temperature rise rates T1 to T4, i.e. a temperature rise rate A is defined by the temperature rise rate T1 divided by the temperature rise rate T3 (A=T1/T3); a temperature rise rate B is defined by the temperature rise rate T2 divided by the temperature rise rate T4 (B=T2/T4); and a temperature rise rate C is defined by the temperature rise rate T1 divided by the temperature rise rate T2 (C=T1/T2).

Meanwhile, the temperature rise rate T1 is an example of a first rise rate in claims; the temperature rise rate T2 is an example of a second rise rate in claims; the temperature rise rate T3 is an example of a third rise rate in claims; and the temperature rise rate T4 is an example of a fourth rise rate in claims. Moreover, the temperature rise rate A means a result of comparison between the temperature rise rates T1 and T3; the temperature rise rate B means a result of comparison between the temperature rise rates T2 and T4; and the temperature rise rate C means a result of comparison between the temperature rise rates T1 and T2.

In the following, the abnormality determination by using the temperature rise rates T1 to T4 and the temperature rise rates A to C will be explained.

Figure 7:
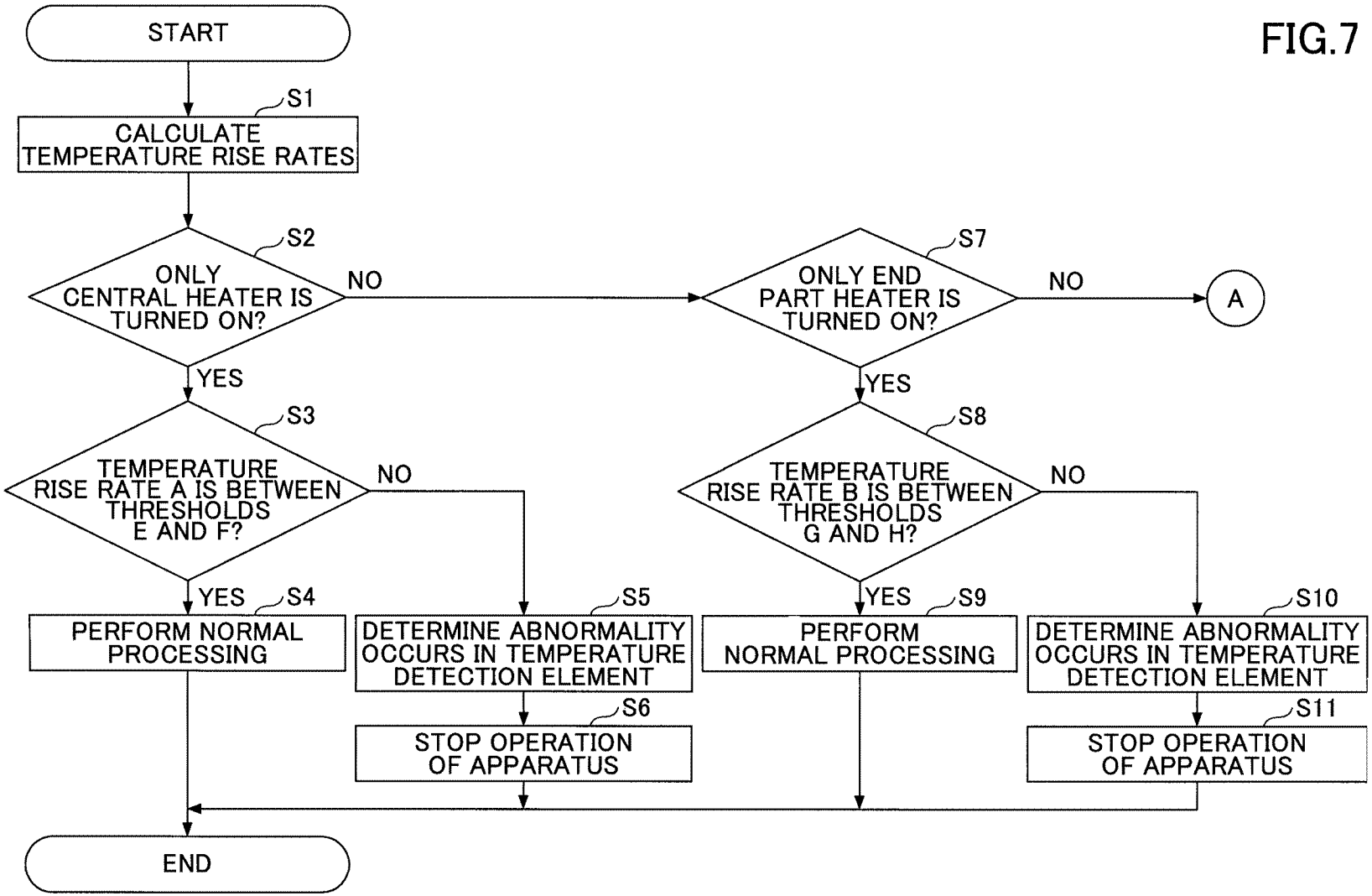
FIG. 7 is a flowchart illustrating an example of a procedure of detecting an abnormality in the temperature detection element or of detecting a reduction of an input voltage according to the present embodiment.

FIG. 7 is a flowchart illustrating an example of a procedure of detecting an abnormality in the temperature detection element. The process starts by the fixing device 18 turning on at least one of the central heater 111 and the end part heater 112. At first, the control device 101 calculates temperature rise rates T1 to T4 (Step S1). Then, the control device 101 determines whether only the central heater 111 is turned on, upon calculating the temperature rise rates T1 to T4 (step S2). In the case where it is determined that only the central heater 111 is turned on (step S2: YES), the control device 101 further determines whether the temperature rise rate A is greater than a threshold E and less than a threshold F (step S3). In the case where it is determined that the temperature rise rate A is greater than the threshold E and less than the threshold F (step S3: YES), the control device 101 determines that an abnormality in the temperature detection element does not occur in the central-heating roller temperature detection element 110 and the central-pressure roller temperature detection element 108, and performs normal processing such as a stand-by operation or a print operation (step S4). That is, a manufacturer or the like sets in advance an upper limit and a lower limit of the temperature rise rate A obtained from the temperature rise rate T1 detected by the central-heating roller temperature detection element 110 and the temperature rise rate T3 detected by the central-pressure roller temperature detection element 108 which are normal in the case where only the central heater 111 is turned on. The lower limit and the upper limit are denoted by the threshold E and the threshold F, respectively. Accordingly, in the case where the temperature rise rate A falls within the range defined by the thresholds E and F, it is determined to be normal.

Moreover, in the case where it is determined that the temperature rise rate A is less than or equal to the threshold E or greater than or equal to the threshold F (step S3: NO), the control device 101 determines that an abnormality occurs in at least one of the central-heating roller temperature detection element 110 and the central-pressure roller temperature detection element 108 (step S5). Since the control device 101 cannot determine in which of the central-heating roller temperature detection element 110 and the central-pressure roller temperature detection element 108 the abnormality occurs, the control device 101 determine that the abnormality occurs in both the central-heating roller temperature detection element 110 and the central-pressure roller temperature detection element 108.

Therefore, also in the case where only the central heater 111 is turned on, according to the process at step S3, an abnormality in the central-heating roller temperature detection element 110 and the central-pressure roller temperature detection element 108 can be detected.

The control device 101 stops the operation of the image forming apparatus 100 (step S6), since the abnormality occurs in the central-heating roller temperature detection element 110 and the central-pressure roller temperature detection element 108.

In the case where it is not determined that only the central heater 111 is turned on (step S2: NO), the control device 101 determines whether only the end part heater 112 is turned on (step S7). In the case where it is determined that only the end part heater 112 is turned on (step S7: YES), the control device 101 further determines whether the temperature rise rate B is greater than a threshold G and less than a threshold H (step S8). In the case where it is determined that the temperature rise rate B is greater than the threshold G and less than the threshold H (step S8: YES), the control device 101 determines that an abnormality does not occur in the end part-heating roller temperature detection element 109 and the end part-pressure roller temperature detection element 107, and performs normal processing such as a stand-by operation or a print operation (step S9). That is, the manufacturer or the like sets in advance an upper limit and a lower limit of the temperature rise rate B obtained from the temperature rise rate T2 normally detected by the end part-heating roller temperature detection element 109 and the temperature rise rate T4 detected by the end part-pressure roller temperature detection element 107. The lower limit and the upper limit are denoted by the threshold G and the threshold H, respectively. Accordingly, in the case where the temperature rise rate B falls within the range defined by the thresholds G and H, it is determined to be normal.

Moreover, in the case where it is determined that the temperature rise rate B is less than or equal to the threshold G or greater than or equal to the threshold H (step S8: NO), the control device 101 determines that an abnormality occurs in at least one of the end part-heating roller temperature detection element 109 and the end part-pressure roller temperature detection element 107 (step S10). Since the control device 101 cannot determine in which of the end part-heating roller temperature detection element 109 and the end part-pressure roller temperature detection element 107 the abnormality occurs, the control device 101 determine that the abnormality occurs in both the end part-heating roller temperature detection element 109 and the end part-pressure roller temperature detection element 107.

Therefore, also in the case where only the end part heater 112 is turned on, according to the process at step S8, an abnormality in the end part-heating roller temperature detection element 109 and the end part-pressure roller temperature detection element 107 can be detected. Moreover, the control device 101 stops the operation of the image forming apparatus 100 (step S11), since the abnormality occurs in the end part-heating roller temperature detection element 109 and the end part-pressure roller temperature detection element 107.

Figure 8:
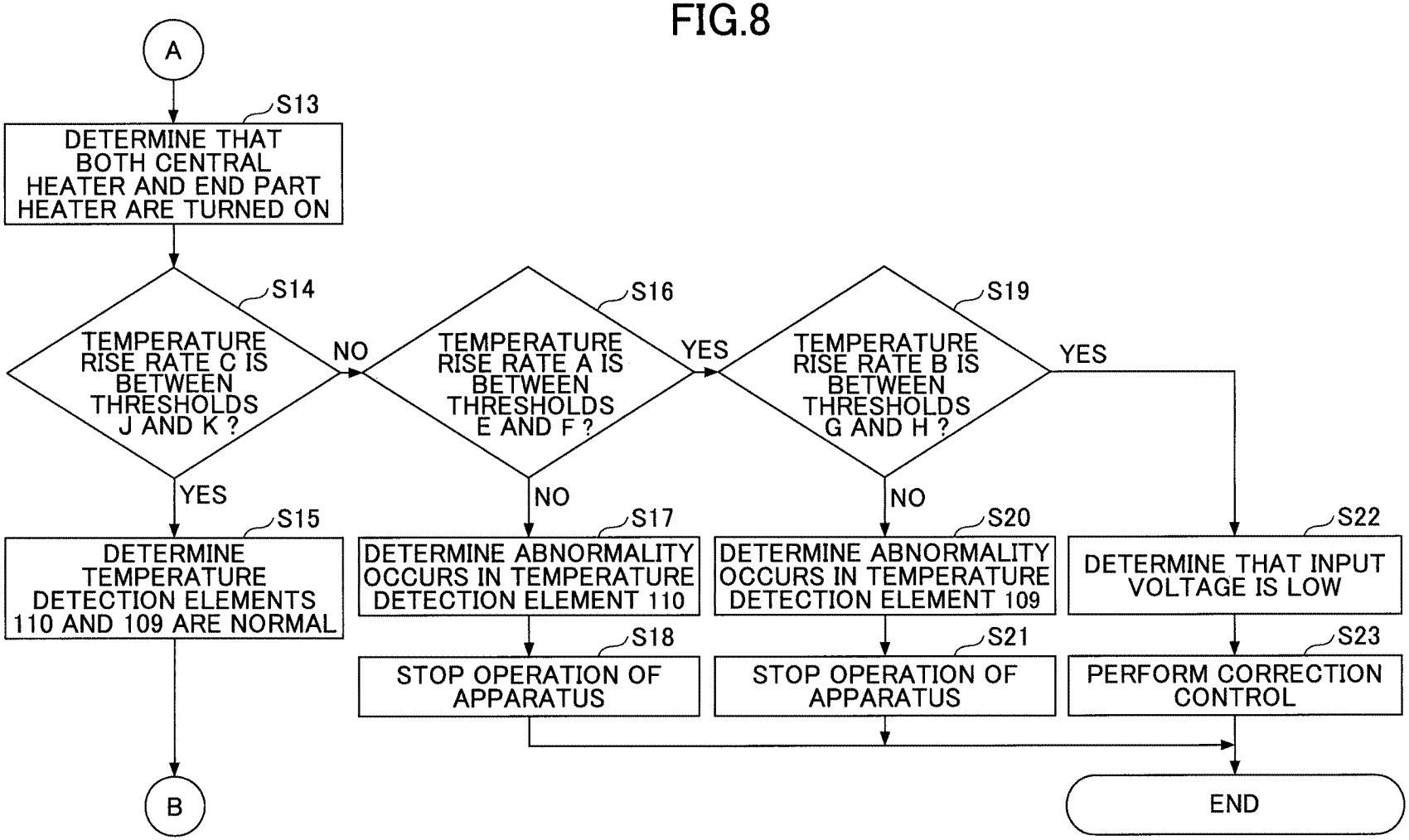
FIG. 8 is a flowchart illustrating another example of the procedure of detecting an abnormality in the temperature detection element or of detecting a reduction of an input voltage according to the present embodiment.

Processing in the case where it is not determined that only the end part heater 112 is turned on (step S7: NO) will be explained with reference to FIG. 8. FIG. 8 is a flowchart illustrating an example of the procedure of detecting an abnormality in the temperature detection element in the case where it is not determined that only the end part heater 112 is turned on.

Figure 9:
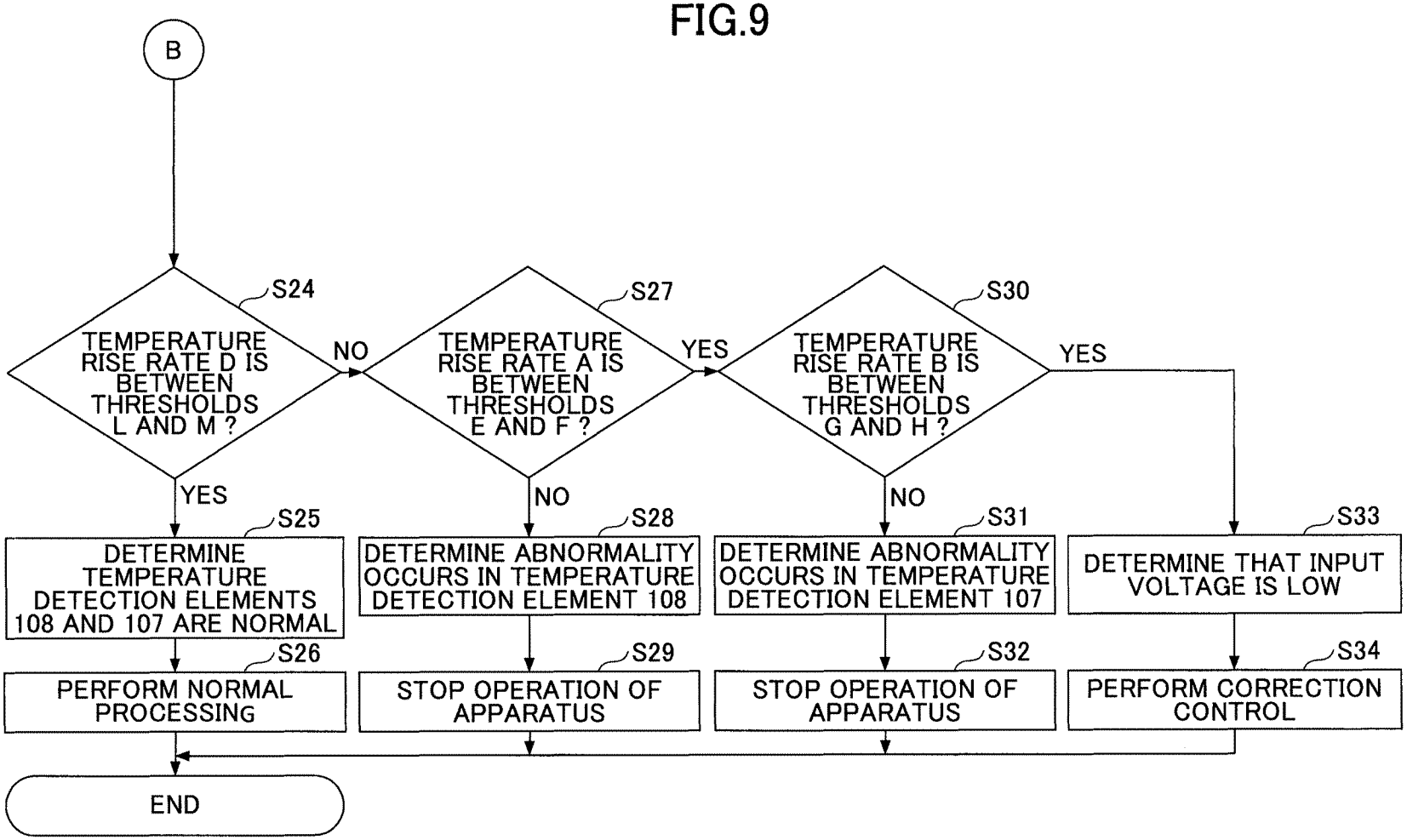
FIG. 9 is a flowchart illustrating yet another example of the procedure of detecting an abnormality in the temperature detection element or of detecting a reduction of an input voltage according to the present embodiment.

In the case where it is determined that not only the end part heater 112 is turned on (step S7: NO), the control device 101 determines that both the central heater 111 and the end part heater 112 are turned on (step S13). Then, the control device 101 determines whether the temperature rise rate C is greater than a threshold J and less than a threshold K (step S14). In the case where it is determined that the temperature rise rate C is greater than the threshold J and less than the threshold K (step S14: YES), the control device 101 determines that an abnormality does not occur in the central-heating roller temperature detection element 110 and the end part-heating roller temperature detection element 109 (step S15), and the processing proceeds to step S24 in FIG. 9, which will be described later. An upper limit and a lower limit of the temperature rise rate C obtained from the temperature rise rate T1 normally detected by the central-heating roller temperature detection element 110 and the temperature rise rate T2 detected by the end part-heating roller temperature detection element 109 are set in advance. The lower limit and the upper limit are denoted by the threshold J and the threshold K, respectively. Accordingly, in the case where the temperature rise rate C falls within the range defined by the thresholds J and K, the central-heating roller temperature detection element 110 and the end part-heating roller temperature detection element 109 are determined to be normal.

In the case where the temperature rise rate C is less than or equal to the threshold J or greater than or equal to the threshold K (step S14: NO), the control device 101 determines whether the temperature rise rate A is greater than the threshold E and less than the threshold F (step S16). Moreover, in the case where the temperature rise rate A is less than or equal to the threshold E or greater than or equal to the threshold F (step S16: NO), the control device 101 determines that an abnormality occurs in the central-heating roller temperature detection element 110 (step S17). This is because an abnormality in the central-heating roller temperature detection element 110 (for T1) is likely to be the reason why neither the temperature rise rate A (=T1/T3) nor the temperature rise rate C (=T1/T2) falls within the region defined by the thresholds even though both the central heater 111 and the end part heater 112 are turned on.

The control device 101 stops the operation of the image forming apparatus 100 (step S18), since the abnormality occurs in the central-heating roller temperature detection element 110.

Moreover, in the case where the temperature rise rate A is greater than the threshold E and less than the threshold F (step S16: YES), the control device 101 determines whether the temperature rise rate B is greater than the threshold G and less than the threshold H (step S19). In the case where the temperature rise rate B is less than or equal to the threshold G or greater than or equal to the threshold H (step S19: NO), the control device 101 determines that an abnormality occurs in the end part-heating roller temperature detection element 109 (step S20). This is because an abnormality in the end part-heating roller temperature detection element 109 (for T2) is likely to be the reason why the temperature rise rate C (=T1/T2) does not fall within the region defined by the thresholds J and K at step S14, the temperature rise rate A (=T1/T3) falls within the region defined by the thresholds E and F at step S16 and the temperature rise rate B (=T2/T4) does not fall within the region defined by the thresholds G and H at step S19.

The control device 101 stops the operation of the image forming apparatus 100 (step S21), since the abnormality occurs in the end part-heating roller temperature detection element 109.

In the case where the temperature rise rate B is greater than the threshold G and less than the threshold H (step S19: YES), the control device 101 determines that the input voltage is low (step S22). That is, this is because insufficient electric power for the central heater 111 and the end part heater 112 is likely to be the reason why the temperature rise rate C does not fall within the region defined by the thresholds at step S14, the temperature rise rate A falls within the region defined by the thresholds at step S16 and the temperature rise rate B falls within the region defined by the thresholds at step S19.

Accordingly, by the determinations at steps S14, S16 and S19, it is also possible to determine whether the input voltage is low, not only determining whether an abnormality occurs in the temperature detection element.

In the case where the control device 101 determines that the input voltage is low (step S22), the control device 101 performs correction controls (step S23) as follows:

(1) ON duty of the fixing heaters is increased, and thereby the electric power supplied to the fixing heaters is increased (amount of heat supplied to the fixing device 18 per unit time is increased);

(2) Conveyance velocity is decreased (time for the paper passing through the inside of the fixing device is increased, thereby the fixing is performed properly; and (3) Time between adjacent papers is increased (time for providing heat to the fixing device is increased).

The above-described correction controls (1) to (3) may be performed independently, or may be controlled simultaneously. After the process at step S23, the processing may return to the process at step S1.

Processing in the case where both the central-heating roller temperature detection element 110 and the end part-heating roller temperature detection element are determined to be normal (step S14: YES) will be explained with reference to FIG. 9.

In order to determine whether the central-pressure roller temperature detection element 108 and the end part-pressure roller temperature detection element 107, a temperature rise rate D is defined by the temperature rise rate T3 divided by the temperature rise rate T4 (D=T3/T4). Then, the control device 101 determines whether the temperature rise rate D is greater than a threshold L and less than a threshold M (step S24). In the case where it is determined that the temperature rise rate D is greater than the threshold L and less than the threshold M (step S24: YES), the control device 101 determines that an abnormality does not occur in the central-pressure roller temperature detection element 108 and the end part-pressure roller temperature detection element 107 (step S25), and performs normal processing such as a stand-by operation or a print operation (step S26). That is, an upper limit and a lower limit of the temperature rise rate D obtained from the temperature rise rate T3 normally detected by the central-pressure roller temperature detection element 108 and the temperature rise rate T4 detected by the end part-pressure roller temperature detection element 107 are set in advance. The lower limit and the upper limit are denoted by the threshold L and the threshold M, respectively. Accordingly, in the case where the temperature rise rate D falls within the range defined by the thresholds L and M, it is determined to be normal.

In the case where the temperature rise rate D is less than or equal to the threshold L or greater than or equal to the threshold M (step S24: NO), the control device 101 determines whether the temperature rise rate A is greater than the threshold E and less than the threshold F (step S27). Moreover, in the case where the temperature rise rate A is less than or equal to the threshold E or greater than or equal to the threshold F (step S27: NO), the control device 101 determines that an abnormality occurs in the central-pressure roller temperature detection element 108 (step S28). This is because an abnormality in the central-pressure roller temperature detection element 108 (for T3) is likely to be the reason why neither the temperature rise rate A (=T1/T3) nor the temperature rise rate D (=T3/T4) falls within the region defined by the thresholds even though both the central heater 111 and the end part heater 112 are turned on.

The control device 101 stops the operation of the image forming apparatus 100 (step S29), since the abnormality occurs in the central-pressure roller temperature detection element 108.

Moreover, in the case where the temperature rise rate A is greater than the threshold E and less than the threshold F (step S27: YES), the control device 101 determines whether the temperature rise rate B is greater than the threshold G and less than the threshold H (step S30). In the case where the temperature rise rate B is less than or equal to the threshold G or greater than or equal to the threshold H (step S30: NO), the control device 101 determines that an abnormality occurs in the end part-pressure roller temperature detection element 107 (step S31). This is because an abnormality in the end part-pressure roller temperature detection element 107 (for T4) is likely to be the reason why the temperature rise rate D (=T3/T4) does not fall within the region defined by the thresholds L and M at step S24, the temperature rise rate A (=T1/T3) falls within the region defined by the thresholds E and F at step S27 and the temperature rise rate B (=T2/T4) does not fall within the region defined by the thresholds G and H at step S30.

The control device 101 stops the operation of the image forming apparatus 100 (step S32), since the abnormality occurs in the end part-pressure roller temperature detection element 107.

In the case where the temperature rise rate B is greater than the threshold G and less than the threshold H (step S30: YES), the control device 101 determines that the input voltage is low (step S33). That is, this is because insufficient electric power for the central heater 111 and the end part heater 112 is likely to be the reason why the temperature rise rate D does not fall within the region defined by the thresholds at step S24, the temperature rise rate A falls within the region defined by the thresholds at step S27 and the temperature rise rate B falls within the region defined by the thresholds at step S30.

Accordingly, by the determinations at steps S24, S27 and S30, it is also possible to determine whether the input voltage is low, not only determining whether an abnormality occurs in the temperature detection element.

In the case where the control device 101 determines that the input voltage is low (step S33), the control device 101 performs correction controls (step S34) which are the same as those at step S22. After the process at step S34, the processing may return to the process at step S1.

According to the above-described operations, it is possible to determine whether an abnormality occurs in the temperature detection element, in the case where only the central heater 111 and the end part heater 112 are turned on. Moreover, it is possible to determine two cases i.e. (i) the case where the input voltage is low and (ii) the case where an abnormality occurs in the temperature detection element and a temperature lower than an actual temperature is detected.

<Variation>

Although the present invention has been described with reference to embodiments, the present invention is not limited to these embodiments, but various variations and modifications may be made without departing from the scope of the invention as set forth in the accompanying claims.

For example, in the processes for comparing the temperature rise rates at steps S3, S8, S14, S16 and S19 in FIGS. 7 and 8, ratios of the temperature rise rates are compared. However, the present invention is not limited to the above, and differences between the temperature rise rates may be compared. For example, the differences may be compared as follows. At step S3 or S16, it is determined whether a difference between the temperature rise rate T1 and the temperature rise rate T3 (T1−T3) is greater than the threshold E and less than the threshold F; at step S8 or S19, it is determined whether a difference between the temperature rise rate T2 and the temperature rise rate T4 (T2−T4) is greater than the threshold G and less than the threshold H; and at step S14, it is determined whether a difference between the temperature rise rate T1 and the temperature rise rate T2 (T1−T2) is greater than the threshold J and less than the threshold K.

Moreover, in the definitions of the temperature rise rates A to C, the numerators and the denominators may be exchanged, respectively, i.e. the temperature rise rate A may be defined by the temperature rise rate T3 divided by the temperature rise rate T1 (A=T3/T1); the temperature rise rate B may be defined by the temperature rise rate T4 divided by the temperature rise rate T2 (A=T4/T2); and the temperature rise rate C may be defined by the temperature rise rate T2 divided by the temperature rise rate T1 (A=T2/T1).

Moreover, in the above-described embodiment, the central-heating roller temperature detection element 110 and the central-pressure roller temperature detection element 108 are arranged at almost the same position (about center) in the axis direction of the heating roller 106 and the pressure roller 105, respectively. However, they are not necessarily arranged at exactly the same position. For example, their positions may be different by about a width of the temperature detection element as well as due to an attachment error. In the same way, the positions of the end part-heating roller temperature detection element 109 and the end part-pressure roller temperature detection element 107 may be different.

Moreover, the AC power source 104 is not limited to a commercial power supply. An electric power may be supplied by a private power generation.

The present application is based on and claims the benefit of priority of Japanese Priority Application No. 2014-119764 filed on Jun. 10, 2014, the entire contents of which are hereby incorporated by reference.

DESCRIPTION OF THE REFERENCE NUMERALS 1001, 1002 temperature detection element
2A, 2B, 2C, 2D developing unit
3 secondary transfer drive roller
4 transfer belt tension roller
5A, 5B, 5C, 5D photoconductor
6A, 6B, 6C, 6D charging roller
7 exposure device
8A, 8B, 8C, 8D developing roller
9A, 9B, 9C, 9D cleaning unit
10A, 10B, 10C, 10D laser light
11A, 11B, 11C, 11D transfer device
12 transfer belt
13 secondary transfer roller
14 paper feeding tray
15A, 15B, 15C, 15D supply roller
16 paper feeding roller
17 registration roller
18 fixing device
19 paper ejection roller
20 double-side roller
21 paper ejection sensor
22A, 22B, 22C, 22D toner container
23 waste toner box
24 paper conveyance mechanism
25 paper ejection tray
26 double-side sensor
27 registration sensor
28A, 28B, 28C, 28D agitator
29A, 29B, 29C, 29D screw
42A, 42B, 42C, 42D toner supply clutch
100 image forming apparatus
101 control device
103 switch
104 AC power source
105 pressure roller
106 heating roller
107 end part-pressure roller temperature detection element
108 central-pressure roller temperature detection element
109 end part-heating roller temperature detection element
110 central-heating roller temperature detection element
111 central heater
112 end part heater
121 cleaning device
241 double-sided printing paper feed path

The invention claimed is:

1. A temperature detection device comprising:

a first temperature detection unit configured to detect a first temperature of a first roller at a first position in an axis direction of the first roller;

a second temperature detection unit configured to detect a second temperature of the first roller at a second position in the axis direction of the first roller, the second position being separated from the first position, the first roller being configured to be heated by a plurality of heating units including a central heating unit and an end part heating unit;

a third temperature detection unit configured to detect a third temperature of a second roller at a position substantially the same as the first position in the axis direction of the first roller, the second roller being configured to be in pressure-contact with the first roller;

a fourth temperature detection unit configured to detect a fourth temperature of the second roller at a position substantially the same as the second position in the axis direction of the first roller; and a control unit configured to control the plurality of heating units, wherein the control unit determines a state of at least one of the first, second, third or fourth temperature detection units based on a comparison between a first rise rate of the first temperature and a third rise rate of the third temperature or on a comparison between a second rise rate of the second temperature and a fourth rise rate of the fourth temperature.

2. The temperature detection device as claimed in claim 1 wherein the central heating unit is arranged at a position close to the first position and the end part heating unit is arranged at a position close to the second position, and in a case where the central heating unit and the end part heating unit are turned on, the control unit is configured to determine a state of an input voltage applied to at least one of the plurality of heating units, based on the comparison between the first rise rate and the third rise rate, the comparison between the second rise rate and the fourth rise rate and comparison between the first rise rate and the second rise rate, or the comparison between the first rise rate and the third rise rate, the comparison between the second rise rate and the fourth rise rate and the comparison between the third rise rate and the fourth rise rate.

3. The temperature detection device as claimed in claim 1 wherein the control unit is configured to determine the first temperature detection unit or the third temperature detection unit to be abnormal, in a case where the central heating unit is turned on, and a ratio of the first rise rate to the third rise rate or a difference between the third rise rate and the first rise rate does not fall between a first threshold and a second threshold.

4. The temperature detection device as claimed in claim 1 wherein the control unit is configured to determine the second temperature detection unit or the fourth temperature detection unit to be abnormal, in a case where the end part heating unit is turned on, and a ratio of the second rise rate to the fourth rise rate or a difference between the fourth rise rate and the second rise rate does not fall between a third threshold and a fourth threshold.

5. The temperature detection device as claimed in claim 1 wherein the control unit is configured to determine the first temperature detection unit to be abnormal, in a case where the central heating unit and the end part heating unit are turned on, a ratio of the first rise rate to the second rise rate or a difference between the second rise rate and the first rise rate does not fall between a fifth threshold and a sixth threshold, and a ratio of the first rise rate to the third rise rate or a difference between the third rise rate and the first rise rate does not fall between a first threshold and a second threshold.

6. The temperature detection device as claimed in claim 1 wherein the control unit is configured to determine the second temperature detection unit to be abnormal, in a case where the central heating unit and the end part heating unit are turned on, a ratio of the first rise rate to the second rise rate or a difference between the second rise rate and the first rise rate does not fall between a fifth threshold and a sixth threshold, a ratio of the first rise rate to the third rise rate or a difference between the third rise rate and the first rise rate falls between a first threshold and a second threshold, and a ratio of the second rise rate to the fourth rise rate or a difference between the fourth rise rate and the second rise rate does not fall between a third threshold and a fourth threshold.

7. The temperature detection device as claimed in claim 1 wherein the control unit is configured to determine that an input voltage applied to at least one of the plurality of heating units does not satisfy an operational guaranteed value, in a case where the central heating unit and the end part heating unit are turned on, a ratio of the first rise rate to the second rise rate or a difference between the second rise rate and the first rise rate does not fall between a fifth threshold and a sixth threshold, a ratio of the first rise rate to the third rise rate or a difference between the third rise rate and the first rise rate falls between a first threshold and a second threshold, and a ratio of the second rise rate to the fourth rise rate or a difference between the fourth rise rate and the second rise rate falls between a third threshold and a fourth threshold.

8. The temperature detection device as claimed in claim 1 wherein the control unit is configured to determine the third temperature detection unit to be abnormal, in a case where the central heating unit and the end part heating unit are turned on, a ratio of the third rise rate to the fourth rise rate or a difference between the fourth rise rate and the third rise rate does not fall between a seventh threshold and a eighth threshold, and a ratio of the first rise rate to the third rise rate or a difference between the third rise rate and the first rise rate does not fall between a first threshold and a second threshold.

9. The temperature detection device as claimed in claim 1 wherein the control unit is configured to determine the fourth temperature detection unit to be abnormal, in a case where the central heating unit and the end part heating unit are turned on, a ratio of the third rise rate to the fourth rise rate or a difference between the fourth rise rate and the third rise rate does not fall between a seventh threshold and a eighth threshold, a ratio of the first rise rate to the third rise rate or a difference between the third rise rate and the first rise rate falls between a first threshold and a second threshold, and a ratio of the second rise rate to the fourth rise rate or a difference between the fourth rise rate and the second rise rate does not fall between a third threshold and a fourth threshold.

10. An image forming apparatus including the temperature detection device as claimed in claim 1.

* * * * *